US009661689B2

(12) United States Patent
Dent et al.

(10) Patent No.: US 9,661,689 B2
(45) Date of Patent: May 23, 2017

(54) COOLING AND HOLDING DEVICE FOR HEATING-ELEMENTS, HEATER AND METHOD FOR PRODUCING A COOLING AND HOLDING DEVICE

(71) Applicant: STEGO-HOLDING GMBH, Schwaebisch Hall (DE)

(72) Inventors: Robert Dent, Schwaebisch Hall (DE); Elmar Mangold, Unterschneidheim (DE)

(73) Assignee: STEGO-HOLDING GMBH, Schwaebisch Hall (DE)

( * ) Notice: Subject to any disclaimer, the term of this patent is extended or adjusted under 35 U.S.C. 154(b) by 206 days.

(21) Appl. No.: 14/354,006

(22) PCT Filed: Oct. 22, 2012

(86) PCT No.: PCT/EP2012/070871

§ 371 (c)(1),
(2) Date: Apr. 24, 2014

(87) PCT Pub. No.: WO2013/060647

PCT Pub. Date: May 2, 2013

(65) Prior Publication Data

US 2014/0299293 A1 Oct. 9, 2014

(30) Foreign Application Priority Data

Oct. 24, 2011 (DE) ..... 10 2011 054 752

(51) Int. Cl.
*H05B 3/06* (2006.01)
*H05B 1/02* (2006.01)
(Continued)

(52) U.S. Cl.
CPC ..... *H05B 3/06* (2013.01); *H05B 2203/02* (2013.01); *Y10T 29/49863* (2015.01)

(58) Field of Classification Search
None
See application file for complete search history.

(56) References Cited

U.S. PATENT DOCUMENTS 3,108,174 A 10/1963 Hynes
3,146,519 A 9/1964 Redwine
(Continued)

FOREIGN PATENT DOCUMENTS

CN 1347264 A 5/2002
CN 101868675 A 10/2010
(Continued)

OTHER PUBLICATIONS

International Search Report for PCT/EP2012/070871, English translation attached to original, Both completed by the European Patent Office on Dec. 17, 2012, All together 5 Pages.
(Continued)

*Primary Examiner* — David Angwin
*Assistant Examiner* — Gyounghyun Bae
(74) *Attorney, Agent, or Firm* — Brooks Kushman P.C.

(57) ABSTRACT

A cooling and holding device for heating-elements, more particularly PTC heating-elements, including a flat housing having at least one heating shaft in which there is at least one heating-element, wherein the heating shaft has opposing shaft walls between which the heating-element is clamped, and at least one side slit that separates the shaft walls such that the distance between the shaft walls can be varied for installation of the heating-element, wherein at least one clamping section outwardly protruding from the flat housing, grips the flat housing, spanning the side slit, and is elastically deformed in the mounted state of the heating-element so as to provide a pressing force of the shaft walls on the heating-element in the assembled state.

15 Claims, 7 Drawing Sheets

(51) Int. Cl.
*H05B 3/50* (2006.01)
*H01C 7/13* (2006.01)

(56) References Cited

U.S. PATENT DOCUMENTS 3,662,149 A 5/1972 Lipinski
3,996,447 A * 12/1976 Bouffard ..... H01C 1/1406 174/16.3
4,092,396 A 5/1978 McCartney et al.
4,232,214 A * 11/1980 Shioi ..... H01C 1/1406 219/541
4,331,861 A * 5/1982 Meixner ..... H01C 1/1406 219/505
4,352,008 A 9/1982 Hofer et al.
4,425,692 A 1/1984 Minegishi et al.
4,431,983 A * 2/1984 Rodriguez ..... H01C 1/1406 174/520
4,578,235 A * 3/1986 Schmidgall ..... B28B 21/56 249/63
4,635,026 A * 1/1987 Takeuchi ..... H01C 1/02 219/541
4,654,478 A 3/1987 Ishihara et al.
4,673,801 A 6/1987 Leary et al.
4,814,584 A 3/1989 Bohlender et al.
4,822,980 A 4/1989 Carbone et al.
4,850,097 A * 7/1989 Graf ..... B29C 57/00 264/108
4,855,570 A 8/1989 Wang
4,855,571 A 8/1989 Ting et al.
4,870,249 A 9/1989 Kayanuma et al.
4,874,924 A * 10/1989 Yamamoto ..... A01M 1/2077 392/391
4,931,626 A 6/1990 Shikama et al.
4,942,289 A * 7/1990 Roller ..... H05B 3/14 219/504
4,954,692 A 9/1990 Shikama et al.
5,125,070 A 6/1992 Chung-Tai
5,153,555 A * 10/1992 Enomoto ..... H01C 1/1406 338/22 R
5,166,497 A 11/1992 Meyer et al.
5,192,853 A 3/1993 Yeh
5,198,640 A * 3/1993 Yang ..... H01C 1/02 219/505
5,201,774 A * 4/1993 Greene ..... A61F 2/80 264/274
5,204,044 A 4/1993 Yoneshige
5,300,760 A 4/1994 Batliwalla et al.
5,471,029 A 11/1995 Simmons
5,760,676 A * 6/1998 Yamada ..... H01C 1/1406 337/183
5,845,384 A 12/1998 Retzbach
5,922,231 A 7/1999 Karst et al.
6,054,692 A 4/2000 Hitomi et al.
6,079,716 A 6/2000 Harman, Jr. et al.
6,090,231 A 7/2000 Saito
6,169,472 B1 * 1/2001 Kahr ..... H01C 1/02 338/22 R
6,180,930 B1 * 1/2001 Wu ..... F24H 3/0429 219/530
6,318,864 B1 11/2001 Fukaya et al.
6,455,822 B1 9/2002 Chang
6,847,017 B2 * 1/2005 Starck ..... H05B 3/14 219/530
7,064,301 B2 6/2006 Han et al.
7,217,072 B1 5/2007 Haimer
7,332,693 B2 * 2/2008 Hamburger ..... H01C 1/01 219/504
7,335,855 B2 2/2008 von der Luehe et al.
7,860,381 B2 * 12/2010 Wallhaeusser ..... F02M 31/125 219/205
7,862,271 B2 1/2011 Wang et al.
8,478,117 B2 7/2013 Eisenhauer et al.
8,541,722 B2 9/2013 Lauth et al.
8,975,561 B2 3/2015 Luppold et al.
9,161,391 B2 10/2015 Niederer et al.
2001/0018828 A1 9/2001 Kadotani
2002/0040899 A1 * 4/2002 Chang ..... H05B 3/14 219/540
2003/0095795 A1 5/2003 Birdsell et al.
2005/0034306 A1 2/2005 Patberg et al.
2005/0089626 A1 4/2005 Wang et al.
2009/0277523 A1 11/2009 Miyazaki et al.
2010/0282337 A1 * 11/2010 Christodoulou ..... F16L 47/03 137/318
2012/0140788 A1 6/2012 Carkin et al.
2013/0000108 A1 1/2013 Bohlender et al.

FOREIGN PATENT DOCUMENTS

CN 102529640 A 7/2012
DE 2804749 8/1979
DE 2804818 8/1979
DE 7934523 3/1980
DE 3816819 11/1989
DE 4010620 10/1991
DE 19604218 8/1997
DE 20120821 5/2002
DE 202005020765 7/2006
DE 102006018151 10/2007
EP 1847785 10/2007
EP 1847786 10/2007
EP 2 053 902 A1 4/2009
GB 2 143 708 A 2/1985
GB 2143708 2/1985
JP S5561688 U 4/1980
JP 10-220909 A 8/1998
RU 24482 U1 10/2002
RU 25582 U1 10/2002

OTHER PUBLICATIONS

Taiwanese Office Action dated Jul. 22, 2016, Application No. 101139059, (English translation provided).
Chinese Office Action to Chinese Patent Application No. 201280051845.2 dated Mar. 11, 2015 (no English translation provided) (5 pages).
Chinese Office Action to Chinese Patent Application No. 201280052012.8 dated Mar. 16, 2015 (no English translation provided) (8 pages).

* cited by examiner

COOLING AND HOLDING DEVICE FOR HEATING-ELEMENTS, HEATER AND METHOD FOR PRODUCING A COOLING AND HOLDING DEVICE

CROSS-REFERENCE TO RELATED APPLICATION

This application is the U.S. national phase of PCT Application No. PCT/EP2012/070871 filed on Oct. 22, 2012, which claims priority to German Patent Application No. 10 2011 054 752.5 filed on Oct. 24, 2011, the disclosures of which are incorporated in their entirety by reference herein.

BACKGROUND OF THE INVENTION

1. Field of the Invention

The invention relates to a cooling and holding body for heating elements, in particular PTC heating elements or flat heating panels, a heater having such a cooling and holding body and a method for the manufacture of such a cooling and holding body.

2. Description of the Related Art

In control cabinets, for example, temperature changes cause the formation of condensate which, together with dust and aggressive gases, can cause corrosion. The risk of breakdowns due to leakage currents or flashovers increases as a result. Heaters or fan heaters, in particular PTC semiconductor heaters, which are subject to high requirements in terms of reliability and longevity, are therefore used to ensure consistently optimum climatic conditions for perfect functioning of the components located in the control cabinet.

Such heaters are usually fitted with electric heating elements. The holding device of these heating elements should enable good heat transfer on one hand and consistently secure fixing on the other. The frequent and, depending on the operating conditions, major temperature changes can lead to material fatigue due to aging and therefore to a decrease in the holding force with which the heating elements are fixed. The heat transfer deteriorates as a result. If the holding function is lost completely, the result may even be a total failure of the device.

DE 196 04 218 A1 describes an example of a known heater with a PTC element in which the PTC element is mounted in a rectangular recess arranged centrally. A double wedge arrangement which can be moved by means of an adjusting screw in order to alter the width of the double wedge arrangement is provided in the recess for mounting. The PTC element can therefore be jammed in the recess. The double wedge arrangement is complex and does not eliminate the problem of the decrease in clamping force due to material fatigue. The double wedge arrangement would have to be adjusted by manipulating the screw in order to prevent this.

An improvement of this known device is disclosed in DE 2006 018 151 A1 which refers back to the applicant. In this case, the heating element is disposed in the centrally arranged recess of a heat exchanger, wherein the inner contact surfaces of the recess lie flat against the heating element. The holding force is achieved in that, after installation of the heating element, side walls of the heat exchanger are bent inwards which reduces the gap between the contact surfaces of the recess. The heating element disposed between the contact surfaces is firmly clamped flat as a result. This fastening is a stable holding device which delivers a constantly high holding force and therefore constantly good heat transfer from the heating element to the heat exchanger without readjustment. Bending in of the side walls, however, leads to a plastic deformation of the wall material which is not optimal for the holding conditions because of the frequent temperature changes.

SUMMARY OF THE INVENTION

Thus the object of the invention is to improve a cooling and holding body of the type referred to at the outset to the effect that a secure holding device for the heating element or heating elements in the cooling and holding body is achieved despite frequent temperature changes. The object of the invention is also to specify a heater having such a cooling and holding body and a method for the manufacture of such a cooling and holding body. According to the invention, this object is achieved by the holding and cooling body according to claim 1, the heater according to claim 15 and the method according to claim 16.

BRIEF DESCRIPTION OF THE DRAWINGS

The invention is described in greater detail with further particulars based on embodiments with reference to the associated schematic Figures. These show.

DETAILED DESCRIPTION OF THE PREFERRED EMBODIMENTS

Figure 1:
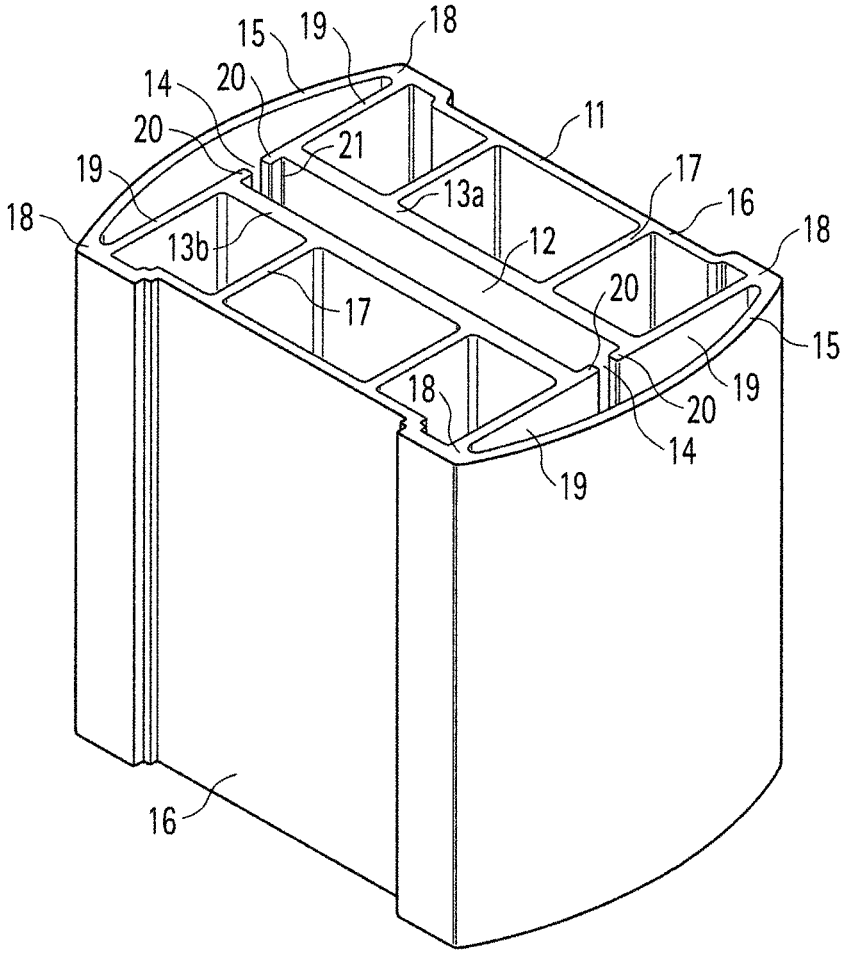
FIG. 1: a perspective view of a cooling and holding body according to an embodiment according to the invention having a single central heating shaft.

The invention is based on the idea of specifying a cooling and holding body for heating elements, in particular electric heating elements, in particular PTC heating elements or flat heating panels, which has a flat housing having at least one heating shaft in which at least one heating element is arranged. The heating shaft has opposing shaft walls between which the heating element is clamped. The heating shaft has at least one side slot which separates the shaft walls in such a manner that the gap between the shaft walls is variable for installation of the heating element. At least one clamping section protruding outwards beyond the flat housing engages on the flat housing. The clamping section spans the side slot and in the assembled condition of the heating element is elastically deformed to generate a contact pressure of the shaft walls which acts on the heating element.

Unlike the known clamping of the heating elements achieved by means of plastic deformation, it is provided according to the invention that the at least one clamping section is elastically deformed. This means that the deformation takes place within the range of Hooke's straight line and is proportional to the stress which is generated in the clamping section. The clamping force with which the heating elements are clamped in the heating shaft is optimized as a result of the deformation below the elastic limit. In contrast to plastic deformation, settling which occurs due to material aging is prevented. The clamping force with which the heating elements are fixed remains constant or at least substantially constant despite the temperature changes. A constantly maximum heat transfer from the heating elements to the material of the holding and cooling body is achieved due to the constantly high clamping force.

Overall, an increase in performance is achieved due to the constantly increased contact or clamping force.

The elastic deformation causes the force with which the heating elements are pressed on to act as a spring force corresponding to the relevant material constant. Readjustment of the contact force or clamping force is not necessary.

According to the invention, the heating shaft has at least one side slot which separates the shaft walls in such a manner that the gap between the shaft walls is variable for installation of the heating element. As a result, the gap between the shaft walls can be enlarged in order to insert the heating element or heating elements into the heating shaft. In the assembled condition of the heating element or elements, the gap between the shaft walls is reduced such that they lie against the heating element for heat transfer and fix the heating element in the heating shaft. The contact force is generated by clamping sections protruding outwards beyond the flat housing or by a single clamping section protruding outwards beyond the flat housing, said clamping section engaging on the flat housing and spanning the side slot. The clamping section or sections are elastically deformed and act as springs or like leaf springs which generate contact forces acting on the heating elements in the region of the shaft walls. The contact forces act inwards in opposing directions.

An interference fit exists in the region of the shaft walls in relation to the height of the heating element arranged there. In this case, the interference between the heating element and the heating shaft is adjusted such that the clamping sections deform or the clamping section deforms elastically due to the side slot or side slots that are somewhat pressed apart. Thus in the assembled condition the heating elements are arranged between the shaft walls in a press fit. The person skilled in the art undertakes the adjustment of an appropriate interference allowance depending on the relevant material properties of the flat housing in such a manner that the elastic deformation of the clamping sections ensues in the assembled condition.

A further advantage of the invention is that the clamping sections can be used for easy assembly of the heating elements. By loading the clamping sections with an assembly force acting inwards in relation to the flat housing, the clamping sections increase their radius and open the side slot which therefore acts as an assembly slot.

This leads to the housing parts which are joined to the clamping sections being deflected outwards. The result is a slight increase in the gap between the shaft walls which is sufficient for introducing or inserting the heating element or heating elements into the heating shaft with an insulating foil.

After assembly, the assembly force is released and the clamping sections attempt to return to their stress-free condition. As the clamping sections are jammed in the process by the heating elements or heating element, they generate the desired holding or contact force on the shaft walls within an elastic range which depends on the relevant material constant. The deformation of the clamping sections for assembly takes place within the range of Hooke's straight line, that is to say below the elastic limit. The mechanical expansion may be supplemented or replaced by a thermal expansion (shrink-fit).

Preferred embodiments of the invention are specified in the dependent claims.

Thus the clamping section protruding outwards beyond the flat housing may be configured as a convexly curved clamping section.

The clamping section's convex curvature means that it curves outwards in relation to the outer walls of the flat housing or protrudes in an arch outwards beyond the straight walls of the flat housing. Alternatively, the clamping section protruding outwards beyond the flat housing may have straight legs, in particular two straight legs that are joined together at an angle. The legs together with the outer wall of the flat housing form a triangle-shaped cross-sectional profile. The gap between the apex of the curved clamping section or between the tip of the triangle-shaped clamping section, that is to say generally the maximum gap between clamping section and flat housing is dimensioned such that there is sufficient spring travel available for assembly. In the case of a plurality of clamping sections, the above-mentioned features are disclosed in connection with all the clamping sections.

In a preferred embodiment, at least one shaft wall and one outer wall of the flat housing running parallel to the shaft wall are joined by at least one crossbar. The stability of the cooling and holding body is increased as a result. Moreover, the crossbars function as cooling ribs which increase the heat transfer of the cooling and holding body's surface.

If the clamping section's points of engagement on the flat housing are arranged above and below the side slot and at a distance from the side slot, the length of the clamping section is increased transverse to the side slot's longitudinal extension. The angle between clamping section and flat housing in the region of the point of engagement is an acute angle and is adjusted such that an assembly force acting perpendicular to the side slot or a contact force acting in the opposite direction can be generated.

The points of engagement may engage on the outer edges of the flat housing. The result is the maximum gap between the points of engagement and the side slot. It is also possible for the clamping section's points of engagement to be arranged further inwards, that is to say closer to the side slot, i.e. between the outer edge of the flat housing and the side slot. This embodiment has the additional advantage that a relatively large radius of the convexly curved clamping section and therefore a smaller gap can be adjusted between the clamping section and the side of the housing. The cooling and holding body may be of compact construction. Expansion of the heating shaft is generally determined by the clamping section's radius or by the chord radius, the spacing of the chord connections or the points of engagement, the material thickness, the material and also the clamping section's shape (for example triangular or curved). The mechanical properties are determined via the relationships between angle of engagement, location bearing and contact gap.

It may also be provided that side walls of the flat housing are each provided perpendicular to the heating shaft between the side slot and the clamping section's points of engagement, said side walls being joined to the clamping section at the points of engagement. In each case, the transition from the side walls to the clamping section has a curvature or a radius on the inner side. The notch effect and therefore the plastic deformation is reduced or prevented completely by the curvature in the region of the transition from the side walls to the clamping section. The margin of safety against a reduction in the contact force due to temperature change and the margin of safety against component failure, for example during assembly when the clamping sections are pressed inwards, is further increased as a result.

Guide noses which protrude beyond an inner edge of the shaft walls may be provided on the side slot. This makes it easier to insert the heating elements or heating element and coaxial alignment of the heating element in the heating shaft.

If a single central heating shaft is provided, the cooling and holding body may be constructed particularly compactly and easily, for example by means of continuous casting.

To increase the heating performance, at least two parallel heating shafts, which are separated by a core arranged between the heating shafts, may be provided. In this case, every heating shaft has at least one side slot. This embodiment enables the stacked arrangement of a plurality of heating elements on various levels, wherein the ease of installation and constant contact force are retained because of the elastic deformation of the clamping sections or clamping section. As a rule, in addition to an essentially cuboid design of the flat housing, an essentially quadratic shape is possible for the attachment of a fan with appropriate screw or clip fastenings. The length of the flat housing can affect the performance yield.

The inner shaft walls in each case can be formed by the core's outer walls, wherein the outer walls for their part are joined together by means of crossbars. The core therefore forms a mutual limitation for both heating shafts in that the outer walls of the core each form the inner shaft walls. The outer shaft walls of both heating shafts are formed by the flat housing and are arranged in each case nearer to the flat housing's outer surface. Joining of the core's outer walls by means of crossbars increases the stability of the cooling and holding body on one hand, in particular of the core, and the effective area for heat transfer on the other. The crossbars also function as cooling ribs.

A single clamping section is preferably assigned to each side slot. Alternatively, a single clamping section may be assigned to a plurality of side sections which are located on one and the same side of the flat housing. The assignment of a single clamping section to a plurality of side sections leads to a simple construction of the cooling and holding body. Installation of the heating elements in the individual heating shafts is simplified if a single clamping section is assigned to each side section.

The thickness of the clamping sections or of the chords preferably varies between the points of engagement, i.e. transverse to the flat housing's longitudinal extension. Increased buckling loads are possible as a result of this. Specifically, the clamping sections are thicker in the center and become thinner towards the ends of the legs, i.e. towards the points of engagement.

In a preferred embodiment, the core is permanently joined to the flat housing, in particular permanently joined by means of the clamping sections. This embodiment is particularly suitable for the design in which each side slot has its own clamping section. The clamping sections have the dual function of applying contact force on one hand and of fixing the core in a specific position on the other, in particular centrally in the cooling and holding body, Other arrangements of the core are possible in the cooling and holding body.

Alternatively, the core may be arranged freely in the flat housing. This means that the core is not directly joined to the flat housing, i.e. is not in material contact. This embodiment is particularly suitable in combination with the single clamping section, where a plurality of side slots are assigned to one and the same side of the flat housing.

In a preferred embodiment of the invention, a first longitudinal edge of at least one shaft wall is joined to the flat housing. A second longitudinal edge of the shaft wall is arranged opposite the first longitudinal edge, wherein the second longitudinal edge is freely movable in such a manner that the position of the shaft wall is variable. This embodiment ensures that the spring travel for changing the gap between the shaft walls is increased. To do this, the shaft wall is coupled to the flat housing on a first longitudinal edge. The second longitudinal edge which opposes the first longitudinal edge is free and can be moved in relation to the flat housing in such a manner that the position of the shaft wall is variable. The movement of the shaft wall is initiated by a deformation of the flat housing via the first longitudinal edge. The connection to the flat housing with a single shaft wall described in this context is also disclosed and claimed in the context of both shaft walls.

It is possible to achieve a further increase in performance if, with the construction described previously, the shaft wall is joined to a bracing rib which engages on the shaft wall between the two longitudinal edges and is joined to the flat housing in the region of the first longitudinal edge. As a result of this, the movement is introduced into the shaft wall not only in the region of the first longitudinal edge but also by means of the bracing rib. The contact force on the heating element is improved as a result and the performance is therefore increased.

According to an independent aspect of the invention, a heater having a cooling and holding body according to one of the embodiments referred to above or having a cooling and holding body according to the invention is disclosed, wherein a fan is arranged at an axial end of the cooling and holding body in such a way that gas can flow through and/or around the cooling and holding body in the longitudinal direction. Such a heating device may be used, for example, for air conditioning of a control cabinet or for other applications.

With the method according to the invention for the manufacture of a cooling and holding body, the gap between the shaft walls is enlarged for mating, wherein the flat housing is heated and/or the gap between the shaft walls is enlarged by applying an assembly force running transverse to the relevant heating shaft on the clamping section or clamping sections which results in the clamping sections or clamping section being pressed together. As a result, the gap between the shaft walls is enlarged because of the side slot. In this condition, the heating elements or the heating element and the cooling and holding body can be mated by pushing the heating element into the heating shaft. After this the flat housing is cooled and/or relieved of pressure such that the shaft walls are moved into their holding position and a corresponding contact force is applied to the heating element or heating elements.

FIG. 1 shows a perspective view of a cooling and holding body for an electric heating element (not illustrated) according to an embodiment according to the invention which can be installed in a heating device, for example a fan heater. The fan heater in turn may be used, for example, for air conditioning of a control cabinet. Other applications of such a fan heater are conceivable. Within the scope of the invention, both the cooling and holding body per se with the heating elements arranged therein, that is to say as an independent assembly, and also the whole heater having such a cooling and holding body is disclosed and claimed. Due to its function, the cooling and holding body may also be referred to as a cooling body or heat exchanger.

The heating elements are PTC heating elements known per se, that is to say thermistors with a positive temperature coefficient. Heating elements 10 have a flat rectangular block shape. Other electric heating elements are possible. As can be identified in FIG. 1, the cooling and holding body has a flat housing 11 with a single heating shaft 12 which is configured centrally, i.e. centrally in the flat housing. The flat housing is oblong in shape and has at least one, in particular at least two flat outer walls 16 which run level, i.e. not curved, and parallel to each other. Outer wall 16, in particular both outer walls 16, extend substantially over the whole width of flat housing 11. Both outer walls 16 and heating shaft 12 likewise run parallel to each other. Straight side walls 19 are arranged perpendicular to outer walls 16. Outer walls 16 and side walls 19 are perpendicular to each other. Assigned to side walls 19 are convexly curved clamping sections 15 which limit the outer contour of the flat housing at least in the region of the sides. Flat housing 11 has a substantially rectangular cross-section, wherein the sides of the flat housing are protrude convexly outwards, in particular are convex in shape. Straight side walls 19 arranged perpendicular to outer walls 16 are located inside the sides protruding outwards.

The construction and function of clamping sections 15 will be described in greater detail at another point.

Heating shaft 12 arranged in the flat housing extends in the longitudinal direction of flat housing 11 and has opposing parallel shaft walls 13*a*, 13*b*. In the assembled condition, at least one heating element 10, in particular a plurality of heating elements arranged side by side in the transverse direction of the flat housing, are located in heating shaft 12, wherein shaft walls 13*a*, 13*b* are in close contact with the heating element or heating elements 10 for heat transfer. At the same time, heating elements or heating element 10 is/are fixed in heating shaft 12 in the longitudinal and transverse direction of flat housing 11.

As illustrated in FIG. 1, shaft walls 13*a*, 13*b* are each joined to associated outer walls 16 by crossbars 17. Crossbars 17 are used on one hand for transferring the contact force generated by clamping sections 15 to shaft walls 13*a*, 13*b*. On the other hand, crossbars 17 function as cooling ribs in order to dissipate heat transferred from the heating element to shaft walls 13*a*, 13*b*. Crossbars 17 run parallel to side walls 19 and extend in the longitudinal direction of flat housing 11. In the example according to FIG. 1, two crossbars 17 are provided per shaft wall 13*a*, 13*b*. Crossbars 17 divide the space between relevant shaft wall 13*a*, 13*b* and the associated outer wall into chambers, in the example according to FIG. 1 specifically into three chambers through which air or gas can flow for cooling of the heating element. The chambers are open at both axial ends of the cooling and holding body. A different number of crossbars 17, for example a single crossbar 17 or more than two crossbars 17 is possible. Crossbars 17 are correspondingly arranged or constructed on both sides of heating shaft 12.

Heating shaft 12 has two side slots 14 which are provided on both sides of heating shaft 12 in the transverse direction of the flat housing. Both side slots 14 separate shaft walls 13*a*, 13*b* from each other in such a manner that the gap between both shaft walls 13*a*, 13*b* is variable at least during installation of heating element 10. Shaft walls 13*a*, 13*b* are mechanically decoupled. As a result, shaft walls 13*a*, 13*b* can be moved apart from each other, in particular by applying a suitable assembly force in order to insert heating element 10 into heating shaft 12. In the assembled condition of heating element 10, both shaft walls 13*a*, 13*b* can be moved towards the heating element in such a manner that they come into contact with heating element 10 and impinge it with a contact force for improving heat transfer and for fixing.

It is possible, instead of two side slots 14, to provide a single side slot 14 and to close the heating shaft laterally on the opposing side of the side slot. The closed side of the heating shaft acts as an elastic hinge. As a result, the change in gap between shaft walls 13*a*, 13*b* can continue to be brought about by way of the heating shaft open on one side or by way of the side slot provided on one side. In contrast, both side slots 14 according to FIG. 1 have the advantage that heating element 10 arranged between them can be impinged evenly with a contact force. In principle, however, the invention also functions with only a single side slot 14.

Clamping sections 15 mentioned previously are provided on both transverse sides of flat housing 11 for applying the contact force. Both clamping sections 15 are assigned to side slots 14 and in the assembled condition of the heating element generate opposing contact forces which act on shaft walls 13*a*, 13*b* and therefore from both sides on heating element 10. To do this, clamping sections 15 engage at two points on flat housing 11 and span side slot 14. It is clear that with only a single side slot 14, also only a single clamping section 15 which is assigned to this side section is required.

Figure 4:
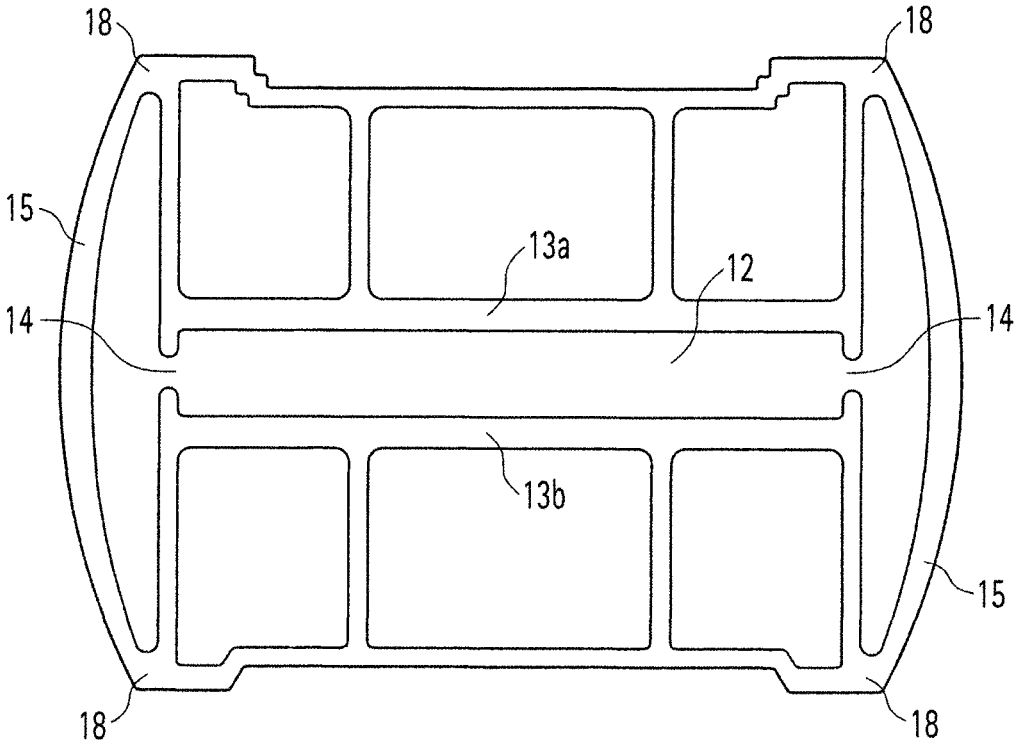
FIG. 4: a view from above onto a cooling and holding body according to a further embodiment having clamping sections whose thickness varies.

Clamping sections 15 extend, as do respectively assigned side slots 14, in the longitudinal direction of the flat housing. Clamping sections 15 are curved transverse to the longitudinal extension. Clamping sections 15 form curve-like or circular segment-like, longitudinally extended components whose end points are joined to flat housing 11 in the region of points of engagement 18. The largest gap between respective clamping sections 15 and flat housing 11 is located in the region of side slot 14. The symmetrical configuration of clamping sections 15 arising from this leads to an even distribution of force. An asymmetrical configuration of clamping sections 15 is possible. In the embodiment according to FIG. 1, convexly curved clamping sections 15 engage on the outer edges of the flat housing and are thus at a maximum distance from respectively associated side slots 14. It is also possible that clamping sections 15 engage further inside on the flat housing, that is to say between the outer edges of the flat housing and side slot 14 in the region of side walls 19. The bow shape of clamping sections 15 may be executed as a radius with variable thickness. This increases stability and the risk of buckling is reduced. This embodiment of clamping sections 15 is disclosed as a design possibility in conjunction with all embodiment examples and is illustrated in FIG. 4. The maximum thickness of each clamping section 15 is approximately at the level of side slot 14 and decreases on both sides towards points of engagement 18 where in each case the minimum thickness is present.

The arrangement of both points of engagement 18 of one clamping element 15 in each case on both sides of side slot 14 means that points of engagement 18 are arranged above and below side slot 14 and at a distance from side slot 14.

As explained, side walls 19 of flat housing 11 are arranged perpendicular in relation to heating shaft 12 and extend between side slot 14 and points of engagement 18 or the end points of each clamping section 15. As can be seen in FIG. 1, side walls 19 are joined on their outside to the end points of clamping sections 15 in the region of points of engagement 18. On the inside of clamping sections 15, the transition from side walls 19 to each clamping section 15 is formed with a curvature, in particular an ideal curvature, in order to keep the notch effect as low as possible.

To generate the elastic contact force, heating shaft 12 and heating element 10 arranged therein are designed with interference. As a result, shaft walls 13*a*, 13*b* are pressed apart by the heating element in the assembled condition. Due to side slots 14, points of engagement 18 of both clamping sections 15 are moved apart in relation to the stress-free neutral position in such a manner that clamping sections 15 are elastically deformed. This results in an elastic restoring force or a corresponding contact force which acts on the heating element via shaft walls 13*a*, 13*b*.

Side walls 19 are lengthened beyond the inner surfaces of shaft walls 13*a*, 13*b* and protrude beyond them or inner edges 21 formed there and as a result form guide noses 20. Guide noses 20 limit side slots 14. Guide noses 20 form lateral limit stops for the heating element arranged in heating shaft 12 which results in easier assembly and forms a mechanical barrier against slipping sideways.

The cooling and holding body according to FIG. 1 has a single centrally arranged heating shaft 12. The invention is not restricted to such cooling and holding bodies but also includes cooling and heating bodies having a plurality of heating shafts, such as is illustrated by way of example on the basis of the embodiments according to FIGS. 2, 3.

Figure 2:
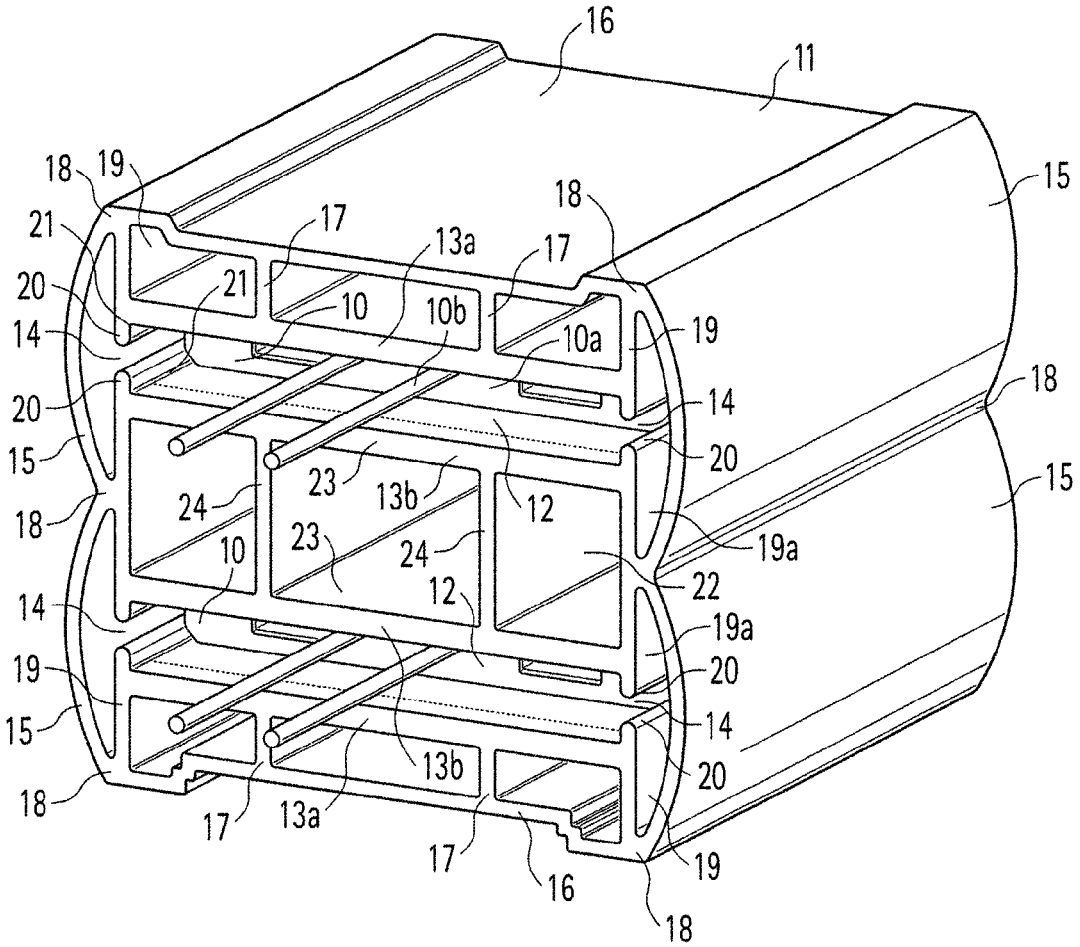
FIG. 2: a perspective view of a cooling and heating body according to a further embodiment having two parallel heating shafts.

The embodiment examples according to FIG. 1 and FIG. 2 conform to the extent that a flat housing 11 which has straight outer walls 16 is provided in both embodiments. Flat housing 11 is limited laterally by side walls 19 which run perpendicular to outer walls 16. Side walls 19 are arranged in the embodiment example according to FIG. 2 and also in the embodiment example according to FIG. 1, inside convexly curved clamping sections 15 which overlap side walls 19 on the outside of flat housing 11.

The flat housing according to FIG. 2 is constructed similar to the embodiment example according to FIG. 1 on the outside of outer shaft walls 13*a*, that is to say in the space between outer shaft walls 13*a* and respectively assigned outer wall 16, and has crossbars 17 which join outer shaft walls 13*a* to associated outer walls 16. Reference is made to the statements according to FIG. 1 in respect of the function and arrangement of crossbars 17.

In both the embodiments according to FIGS. 1 and 2, both outer walls 16 are each offset towards the inside. In the region of points of engagement 18, outer wall 16 forms a shoulder which runs parallel to the offset area of each outer wall 16 and forms the outer edge of flat housing 11. The shoulder merges into clamping sections 15 in the region of points of engagement 18.

Unlike the embodiment according to FIG. 1, in the embodiment according to FIG. 2 a core 22 is provided which is arranged between both outer shaft walls 13*a* and divides flat housing 11 into two parallel heating shafts 12 arranged one above the other. For this, outer surfaces or outer walls 23 of core 22 running parallel to outer shaft walls 13*a* form inner shaft walls 13*b* which in each case together with outer shaft walls 13*a* limit both heating shafts 12.

Core 22 has a rectangular cross-section whose width corresponds to the width of outer shaft walls 13*a*. Side walls 19*a* of core 22 running perpendicular to inner shaft walls 13*b* line up with side walls 19 which are joined to outer shaft walls 13*a*. Together, side walls 19 joined to outer shaft walls 13*a* and side walls 19*a* of core 22 form the (inner) straight side walls of the flat housing which are bridged or overlapped by curved clamping sections 15.

Both heating shafts 12 are each constructed in principle like central heating shaft 12 according to FIG. 1 and function correspondingly. Both heating shafts 12 according to FIG. 2 each have two side slots 14 which decouple core 22 or inner shaft walls 13*b* from outer shaft walls 13*a*. A change in gap or widening of the heating shaft is therefore possible. Reference is made to the statements regarding the example according to FIG. 1 in respect of details and the operating principle of side slots 14.

The contact force is applied by clamping sections 15 illustrated in FIG. 2. Individual clamping sections 15 correspond in shape and arrangement to clamping section 15 according to FIG. 1. Reference will be made to the relevant embodiments. In the embodiment example according to FIG. 2, clamping sections 15 are assigned to each heating shaft 12 on both sides. Overall therefore, four clamping sections 15 are provided, two on each side of flat housing 11. The function of the clamping sections corresponds to the function of the clamping sections according to FIG. 1. Points of engagement 18 of each clamping section 15 are located on one side in the region of the outer edge of flat housing 11. On the other hand, each associated opposing point of engagement 18 of a clamping section 15 is located in the region of side wall 19*a* of core 22. Specifically, clamping sections 15 are joined on one side to the outer edge of the flat housing or in general to flat housing 11 and on the other side to core 22, in particular are firmly bonded or formed integrally. Clamping sections 15 engage in the centre of core 22 on lateral surfaces 19*a*. The transition between side surfaces 19, 19*a* of flat housing 11 or core 22 to relevant clamping sections 15 is executed in each case with a curvature. Heating shafts 12 each have guide noses 20 which are configured as in the embodiment example according to FIG. 1.

The number of heating shafts according to FIG. 2 is to be considered as an example. It is also possible to provide more than two heating shafts with a corresponding number of cores and associated clamping sections which are constructed according to the same principle as illustrated in FIG. 2. Multiple stacking of heating elements in the vertical direction of the cooling and holding body and a corresponding increase in the heating performance is therefore possible.

Core 22 has crossbars 24 which join together outer walls 23 or both inner shaft walls 13*b* and which run in the core's longitudinal direction. On one hand, crossbars 24 increase the stability of core 22. On the other hand, crossbars 24 serve as cooling ribs in order to dissipate heat transferred from the heating element to inner shaft walls 13*b* by means of an enlarged surface. In the example according to FIG. 2, two crossbars 24 which run parallel to side walls 19*a* are provided. A different number, for example only a single crossbar or more than two crossbars, is possible.

In the example according to FIG. 2, both heating elements 10 are shown in the assembled condition, where they are arranged in heating shaft 12 in a press fit. The previously described elastic deformation of four or a plurality of clamping sections 15 is reached and the associated contact force is achieved as a result. The heating elements are PTC heating elements of which ceramic base 10*a* can be seen in FIG. 2 as can connecting wires 10*b*. Other electric heating elements may be used. Heating elements 10 are electrically insulated from heating shaft 12 using appropriate insulation materials. This applies to all embodiment examples of this application.

Figure 3:
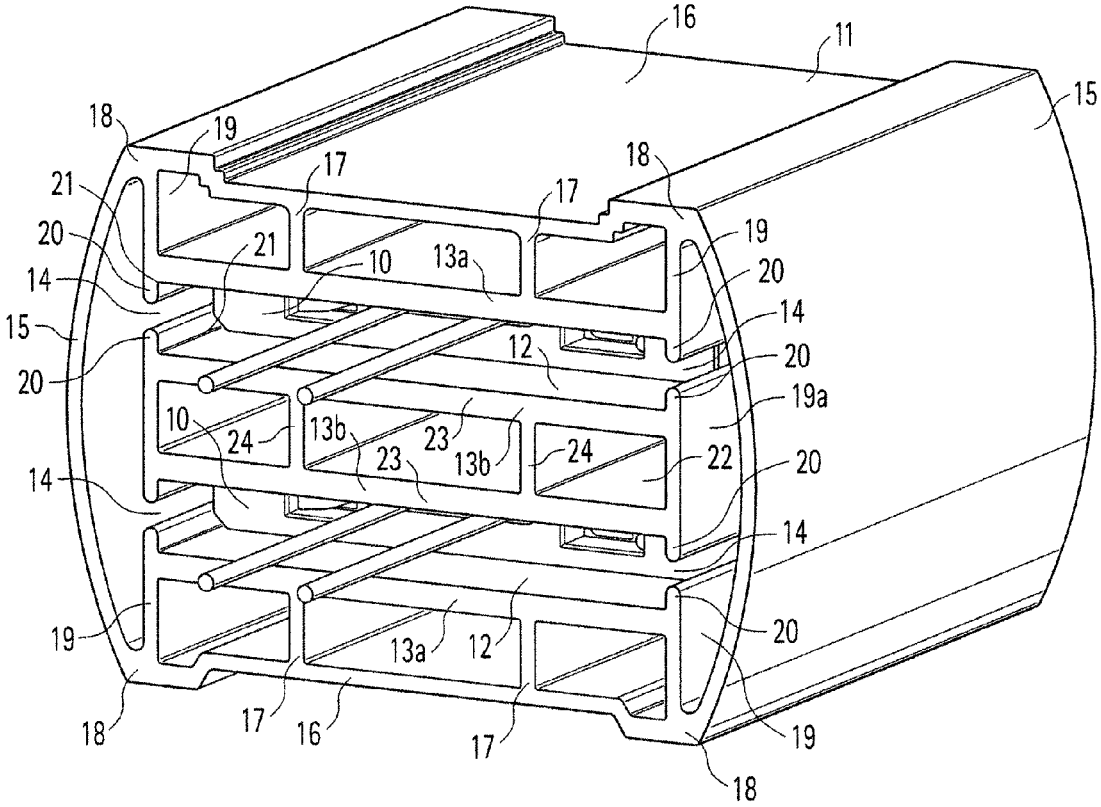
FIG. 3: a perspective view of a further embodiment of a cooling and holding body having two parallel heating shafts and a freely supported core.

In the embodiment example according to FIG. 3, this is a double profile for holding two stacked heating elements as in the embodiment example according to FIG. 2. In this respect, reference is made to the explanations in connection with FIG. 2.

The difference between the embodiments according to FIGS. 2, 3 consists of the arrangement of core 22 and the configuration of clamping sections 15. In core 22 according to FIG. 3, this is a so-called flying or floating core which is freely arranged in flat housing 11. The housing is of multi-layer, specifically two-layer, construction and has at least one core 22 and an outer shell. Core 22 is not directly joined, i.e. not firmly bonded, to flat housing 11. Fixing of core 22 in flat housing 11 is effected by means of the contact forces exerted by clamping sections 15 which compress the heating elements and core 22 arranged between them.

The difference in relation to clamping sections 15 is that a single clamping section 15 is assigned to both heating shafts 12 on each side of the flat housing. Thus, clamping section 15 overlaps both side slots 14 or in general a plurality, in particular all, side slots 14 on the same side of the housing. Common clamping section 15 is attached on both outer edges of flat housing 11 and in this respect corresponds to the embodiment according to FIG. 1. The embodiment according to FIG. 3 has the advantage that it can be manufactured comparatively easily, for example by means of extrusion. To simplify installation, it is conceivable to pre-assemble both heating elements 10 with core 22 and then to insert the pre-assembled unit into widened flat housing 11. In this case, protruding guide noses 20 of outer shaft walls 13*a* are used for orientation. The assembly forces for widening flat housing 11 are applied to both clamping sections 15 in opposing directions in such a manner that convexly curved clamping sections 15 are flattened in such a way that outer shaft walls 13*a* are moved apart. The radius of clamping sections 15 is increased. Once core 22 with both heating elements 10 has been inserted into widened flat housing 11, the assembly force is removed to fix it in place. Due to the interference of heating elements 10 in the vertical direction, clamping sections 15 cannot return to the starting position but remain elastically deformed and as a result the necessary contact force is applied.

This also applies in principle for the embodiment according to FIG. 2, where here core 22 is firmly bonded to clamping sections 15.

With a two or more layer housing, core 22 and the outer shell or flat housing 11 may be constructed of various material combinations having different or identical material expansion coefficients in order to achieve a constant contact pressure.

Figure 5:
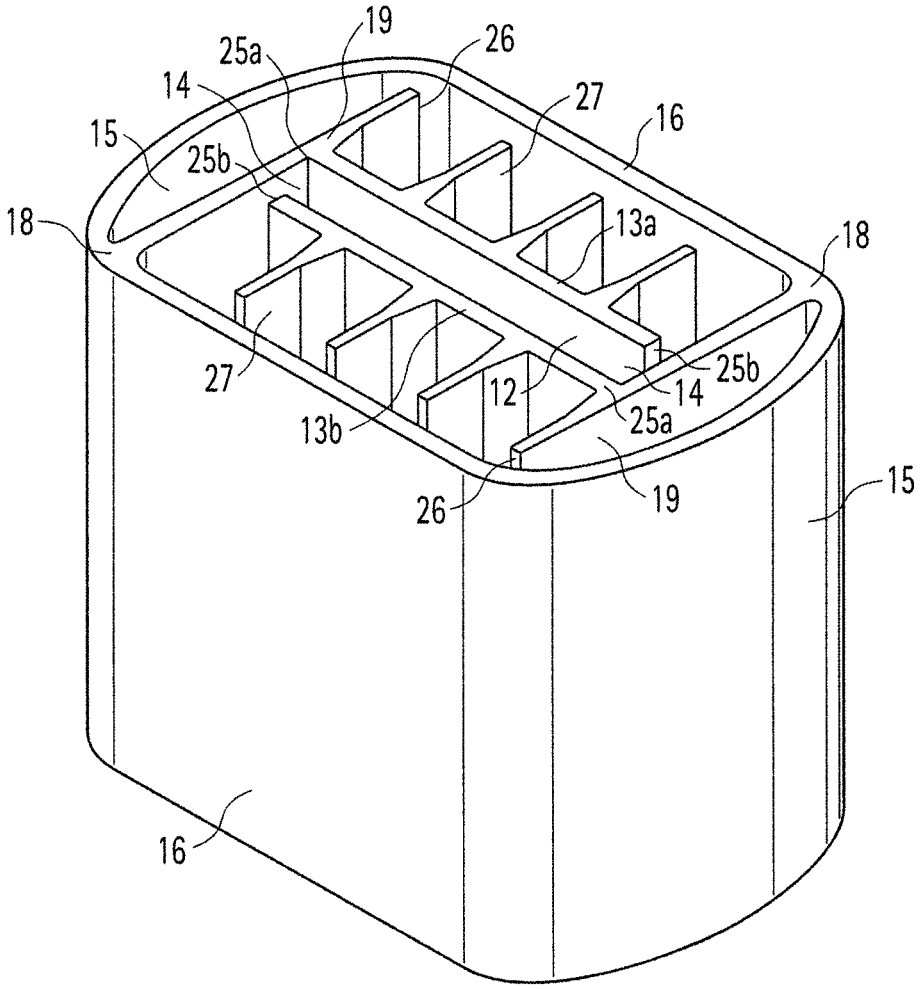
FIG. 5: a perspective view of a further embodiment of a cooling and holding body having a variant of the heating shaft.
Figure 6:
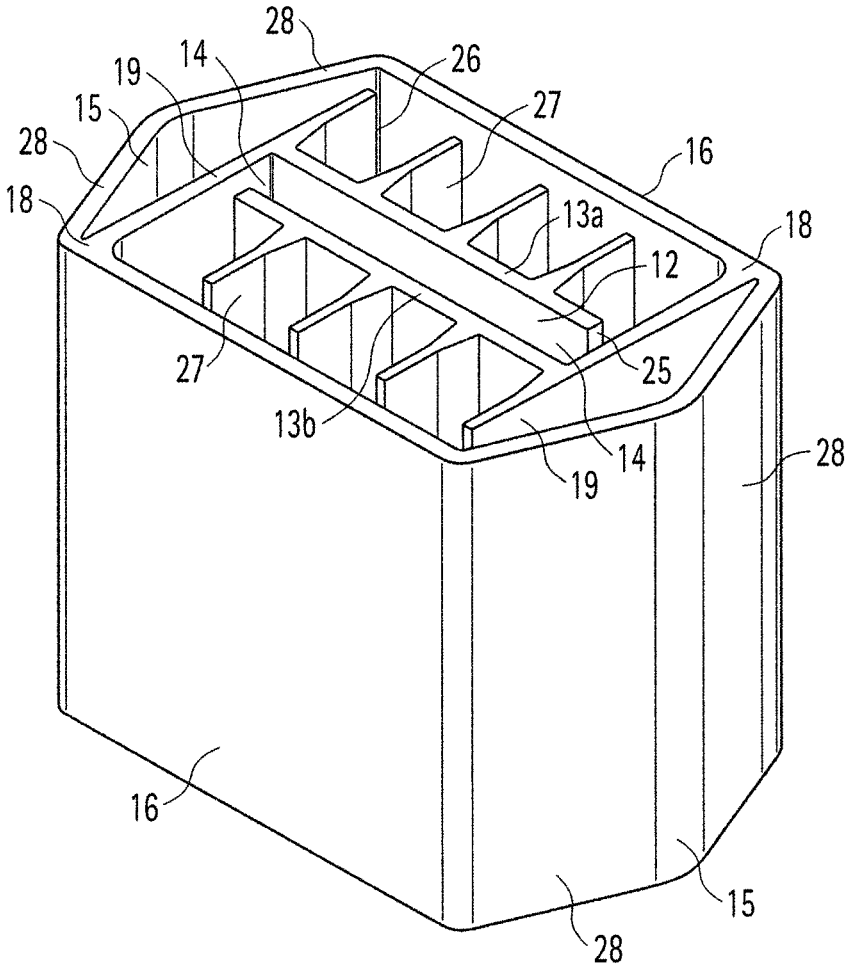
FIG. 6: a perspective view of a further embodiment of a cooling and holding body having a variant of the clamping sections.

FIGS. 5, 6 show two embodiments in which heating shaft 12, specifically the suspension of shaft walls 13*a*, 13*b*, is modified in order to increase the spring travel. This has the advantage that tolerances can be better compensated.

Unlike the embodiment according to FIG. 1, in which both longitudinal edges of a shaft wall 13*a*, 13*b* are joined to flat housing 11, in the embodiments according to FIGS. 5, 6, each shaft wall 13*a*, 13*b* is joined on one side to flat housing 11. Specifically, in each case only a single first longitudinal edge 25*a* of a shaft wall 13*a*, 13*b* is joined to flat housing 11. In each case, the other second longitudinal edge 25*b* of shaft wall 13*a*, 13*b* is free. Second longitudinal edge 25*b* is not joined to flat housing 11 but is movable in relation to flat housing 11.

Both shaft walls 13*a*, 13*b* are correspondingly attached to flat housing 11, wherein free longitudinal edges 25*b* of shaft walls 13*a*, 13*b* are arranged on opposing sides. This means that free longitudinal edge 25*b* of one shaft wall 13*a* is arranged on the same housing side as longitudinal edge 25*a* of other shaft wall 13*b* joined to flat housing 11. Side slot 14 is covered on both sides in each case by a side wall 19 of flat housing 11. Free longitudinal edge 25*b* is at a distance from side wall 19 such that unobstructed movement of free longitudinal edge 25*b* is possible along side wall 19.

Clamping sections 15 engage on the foot of each side wall 19. End 26 of each side wall 19 opposing the foot is free. Free ends 26 of side walls 19 are arranged on opposing sides of the housing or are staggered diagonally.

Clamping sections 15 each overlap side slot 14 and free end 26 of each side wall 19 and are joined to the foot of other side wall 19 on the opposite side of the housing. Clamping sections 15 merge in the region of free ends 26 of side walls 19, without touching them, into respective straight outer wall 16 of the flat housing. The gap between free end 26 of side wall 19 and the overlapping part of clamping section 15 is dimensioned such that adequate spring travel is possible.

If an assembly force is applied to clamping sections 15, the radius of clamping sections 15 is enlarged with the result that side walls 19 attached mirror-inverted are moved apart in opposite directions. The shaft walls attached to the side walls on one side are correspondingly moved at the same time which results in side slot 14 opening for assembly or the gap between shaft walls 13*a*, 13*b* enlarging. The restoring movement after relieving the pressure takes place in the opposite direction.

In this case, deformation of clamping sections 15 takes place below the elastic limit such that, in the operating condition with heating element 10 clamped, the spring force due to the elastic deformation is generated according to the relevant material constant.

As further shown in FIGS. 5, 6, cooling ribs 27 are provided on the outside of the shaft walls. Side wall 19 protrudes beyond associated shaft wall 13*a*, 13*b* and also forms a cooling rib 27. Other shapes of the cooling ribs are possible.

The difference between the variants according to FIGS. 5 and 6 consists in the shape of clamping sections 15 which according to FIG. 6 is arrow-shaped. In other words, clamping sections 15 together with each associated side wall 19 form an approximately triangle-shaped profile in cross-section with straight legs 28, wherein one tip of the triangle-shaped cross-sectional profile is open. The open tip corresponds to free end 26 of relevant side wall 19.

The clamping section according to FIG. 6 is disclosed as an alternative in connection with the remaining embodiment examples.

Figure 7:
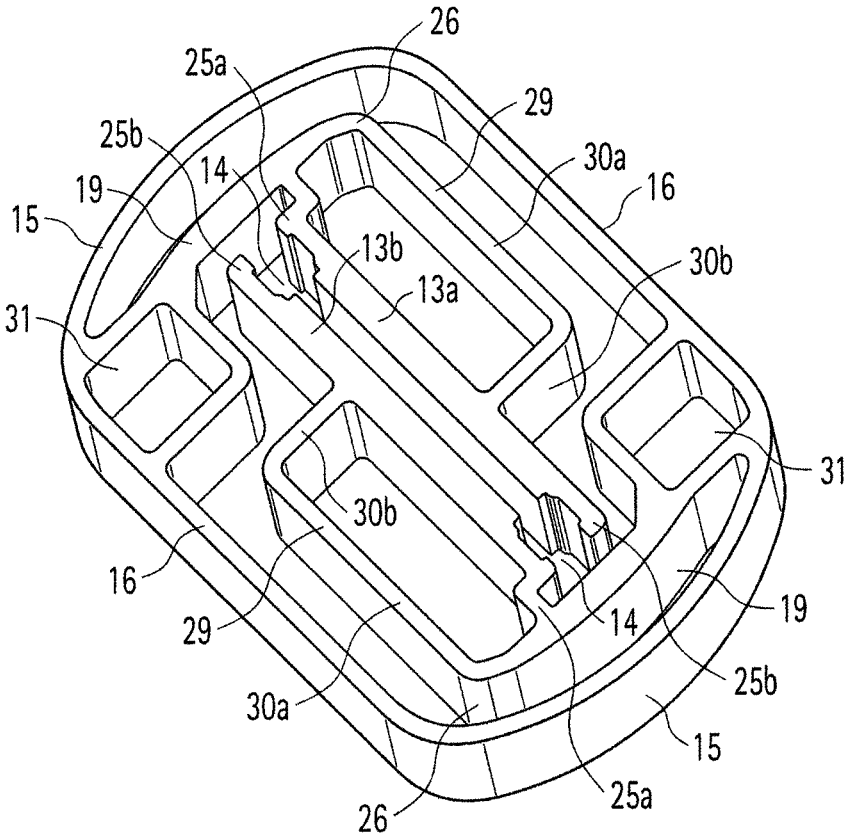
FIG. 7: a perspective view of a further embodiment of a cooling and holding body in which the shaft walls are each provided with bracing ribs.

The cooling and holding body according to FIG. 7 is configured similarly to the cooling and holding body according to FIGS. 5, 6 in its basic construction. As in FIGS. 5, 6, both shaft walls 13*a*, 13*b* are each joined in the region of first longitudinal edge 25*a* to flat housing 11 in such a manner that the movement of shaft walls 13*a*, 13*b* for installation in the region of first longitudinal edge 25*a* is initiated by flat housing 11, in particular by relevant clamping sections 15 of flat housing 11. First longitudinal edges 25*a* of both shaft walls 13*a*, 13*b* are each joined to flat housing 11 on opposing sides. First longitudinal edges 25*a* are diagonally opposed. The same applies to the position of two free longitudinal edges 25*b*. In this respect, the embodiment examples according to FIGS. 5, 6, 7 correspond to each other. Reference is made to the statements regarding FIGS. 5, 6 with respect to the basic construction according to FIG. 7.

The difference between the embodiment example according to FIG. 7 and the examples according to FIGS. 5, 6 consists in that both shaft walls 13*a*, 13*b* are each joined to a bracing rib 29.

Bracing rib 29 engages on the outside of each shaft wall 13*a*, 13*b*, i.e. on the side of each shaft wall 13*a*, 13*b* facing away from heating shaft 12.

The point of engagement or the line of engagement of bracing rib 29 is located in each case between first and second longitudinal edge 25*a*, 25*b* of each shaft wall 13*a*, 13*b*.

Longitudinal rib 29 is joined on the other side to flat housing 11, that is in the region of first longitudinal edge 25*a* of associated shaft wall 13*a*, 13*b*. For this, longitudinal rib 29 forms an extension of each side wall 19 of the flat housing. Side wall 19 is folded above first longitudinal edge 25*a* and forms a bar 30*a* running parallel to outer wall 16. Located in the region of the fold, that is in the transition area between side wall 19 and bracing rib 29, is free end 26 of side wall 19 which is at a distance from outer wall 16 or associated clamping section 15. Parallel bar 30*a* therefore runs between outer wall 16 and associated shaft wall 13*a*, 13*b*. Parallel bar 30*a* is folded at the level of the point of engagement of bracing rib 29 and merges into a crossbar 30*b* which is joined to the outside of shaft wall 13*a*, 13*b*.

Bracing rib 29 extends, as can be seen in FIG. 7, in the longitudinal direction of flat housing 11, that is over the complete axial length of flat housing 11.

Therefore in the embodiment according to FIG. 7, each shaft wall 13*a*, 13*b* is joined to flat housing 11 at two points. As a result, a stability of the shaft walls comparable to that in the embodiment examples according to FIGS. 1-4 is achieved. The contact pressure is also comparable. The connection of each shaft wall 13*a*, 13*b* to flat housing 11 is made in each case on one and the same side of each shaft wall 13*a*, 13*b*. This means that in the case of first shaft wall 13*a*, first longitudinal edge 25*a* and bracing rib 29 are joined on the same side to flat housing 11, specifically to side wall 19 of flat housing 11. This ensures that the movement or contact force transferred by side wall 19 is introduced into one and the same shaft wall 13*a*, 13*b*. The central connection in each case of shaft walls 13*a*, 13*b* to flat housing 11 is made for both shaft walls 13*a*, 13*b* on opposing sides of flat housing 11. This ensures that shaft walls 13*a*, 13*b* are movable in opposite directions or generate the desired contact force on heating element 10 in opposite directions.

The contact force acting in opposite directions is generally achieved by means of the nested arrangement of clamping surfaces 15 and shaft walls 13*a*, 13*b*. The nested arrangement means that the points of engagement at which clamping sections 15 are joined to flat housing 11 are arranged on diagonal corners of flat housing 11. Accordingly, free ends 26 of side walls 19 are arranged on diagonally opposed corners of the flat housing. Due to the diagonal arrangement of the points of engagement of clamping sections 15 or of free ends 26, the points of engagement at which clamping sections 15 are joined to flat housing 11 are pushed apart on enlarging the radius of clamping sections 15, for example by applying an assembly force. As the points of engagement are arranged diagonally opposing, the entire housing is pushed apart or deformed in the transverse direction, i.e. in a direction transverse to heating shaft 12. Due to the connection of shaft walls 13*a*, 13*b* to opposing side walls 19, shaft walls 13*a*, 13*b* are taken along by the movement of side walls 19 and enlarge the gap between shaft walls 13*a*, 13*b* and thus heating shaft 12. The restoring movement after successful installation of heating elements 12 takes place in the opposite direction. The statements above regarding the nested arrangement of clamping surfaces 15 are also disclosed with reference to the examples according to FIGS. 5, 6.

The stability of flat housing 11 according to FIG. 7 is further improved such that, in the lower region of each of side walls 19, bracing chambers 31 are provided which further improve the heat transfer due to the enlarged surface. Bracing chambers 31 are provided in each case at the foot end of side walls 19, i.e. in the region in which clamping sections 19 (sic) are joined to flat housing 11. As can further be seen in FIG. 7, the transitions of clamping sections 15 have curvatures towards flat housing 11 or towards side walls 19 in order to reduce the notch effect. This ensures that the deformation is also below the elastic limit in the region of the transitions, that is within the range of Hooke's straight line.

LIST OF REFERENCE NUMBERS

10 Heating elements
11 Flat housing
12 Heating shaft
13*a*, 13*b* Shaft walls
14 Side slots
15 Clamping sections
16 Outer walls
17 Crossbars
18 Points of engagement
19 Side walls of the flat housing
19*a* Side walls of the core
20 Guide noses
21 Inner edges
22 Core
23 Outer walls
24 Crossbars
25*a* Joined longitudinal edges
25*b* Free longitudinal edges
26 Free ends
27 Cooling ribs
28 Legs
29 Bracing rib
30*a* Parallel bar
30*b* Crossbar

The invention claimed is:

1. A cooling and holding body for heating elements, comprising: a flat housing with at least one hollow heating shaft having opposing parallel shaft walls between which at least one heating element is clampable, and at least one side slot which separates the opposing parallel shaft walls such that a gap between the opposing shaft walls is enlargeable for installation of the at least one heating element, wherein at least one clamping section protruding outwards beyond the flat housing engages on the flat housing, said clamping section spanning the at least one side slot, and in an assembled condition with the heating element in place, the clamping section is elastically deformed to generate a clamping force on the opposing shaft walls, clamping the heating element, between the opposing parallel shaft walls of the flat housing.

2. The cooling and holding body of claim 1, wherein, the clamping section is convexly curved or has straight legs which are joined together at an angle.

3. The cooling and holding body of claim 1, wherein, at least one shaft wall and one outer wall of the flat housing running parallel to the shaft wall are joined by at least one crossbar.

4. The cooling and holding body of claim 1, wherein, points of engagement of the clamping section with the flat housing are arranged above and below the side slot and at a distance from the side slot.

5. The cooling and holding body of claim 4 wherein, side walls of the flat housing are each provided perpendicular to the hollow heating shaft between the side slot and the points of engagement, said side walls joined to the clamping section at the points of engagement, wherein a transition from the side walls to the clamping section has a curvature on the inside.

6. The cooling and holding body of claim 1, wherein, guide noses which protrude beyond an inner edge of the shaft walls are provided on the side slot.

7. The cooling and holding body of claim 1, wherein, a single central heating shaft is provided.

8. The cooling and holding body of claim 1, wherein at least two parallel hollow heating shafts are provided which are separated by a core arranged between the hollow heating shafts, wherein each hollow heating shaft has at least one side slot.

9. The cooling and holding body of claim 8, wherein, the inner shaft walls are formed by outer walls of the core, wherein the outer walls are joined together by means of crossbars.

10. The cooling and holding body of claim 8, wherein, a single clamping section is assigned to each side slot or a single clamping section is assigned to a plurality of side slots on one and the same side of the flat housing.

11. The cooling and holding body of claim 8, wherein, the core is permanently joined to the flat housing by means of the clamping sections.

12. The cooling and holding body of claim 8, wherein, the core is freely arranged in the flat housing.

13. The cooling and holding body of claim 1, wherein, a first longitudinal edge of at least one shaft wall is joined to the flat housing and a second longitudinal edge is arranged opposite the shaft wall of the first longitudinal edge, wherein the second longitudinal edge is arranged in a freely movable manner such that the position of the shaft wall is variable.

14. The cooling and holding body of claim 13, wherein, the shaft wall is joined to a bracing rib which engages on the shaft wall between the two longitudinal edges and is joined to the flat housing in a region of the first longitudinal edge.

15. A heater, comprising a cooling and holding body of claim 1, wherein a fan is arranged at one axial end of the cooling and holding body such that gas can flow through and/or around the cooling and holding body in a longitudinal direction.

* * * * *